US010532002B2

(12) United States Patent
Wenmakers et al.

(10) Patent No.: US 10,532,002 B2
(45) Date of Patent: Jan. 14, 2020

(54) WALKING AID

(71) Applicant: Medical Robots, Hasselt (BE)

(72) Inventors: Dirk Wenmakers, Dilsen (BE); Ria Cuppers, Mechelen (BE); Jos Seyler, Hasselt (BE)

(73) Assignee: Medical Robots, Hasselt (BE)

( * ) Notice: Subject to any disclaimer, the term of this patent is extended or adjusted under 35 U.S.C. 154(b) by 0 days.

(21) Appl. No.: 15/401,574

(22) Filed: Jan. 9, 2017

(65) Prior Publication Data

US 2017/0128315 A1 May 11, 2017

Related U.S. Application Data

(63) Continuation of application No. 14/512,703, filed on Oct. 13, 2014, now Pat. No. 9,592,176.

(30) Foreign Application Priority Data

Oct. 11, 2013 (BE) ..... 2013/0682

(51) Int. Cl.
*A61H 3/04* (2006.01)
*A61H 3/00* (2006.01)

(52) U.S. Cl.
CPC ..... *A61H 3/04* (2013.01); *A61H 3/008* (2013.01); *A61H 2003/007* (2013.01); *A61H 2003/043* (2013.01); *A61H 2201/0165* (2013.01); *A61H 2201/5064* (2013.01); *A61H 2201/5069* (2013.01)

(58) Field of Classification Search
CPC ..... A61H 3/04; A61H 2201/5064; A61H 2201/0165; A61H 2003/043
USPC ..... 280/87.021, 41
See application file for complete search history.

(56) References Cited

U.S. PATENT DOCUMENTS

| | | | |
|---|---|---|---|
| 2,648,545 | A | 8/1953 | Cassidy |
| 3,328,043 | A | 6/1967 | Johnson |
| 5,106,108 | A | 4/1992 | Howell |
| 5,215,355 | A | 6/1993 | Klumpjan |
| 5,265,891 | A | 11/1993 | Diehl |
| 6,131,917 | A | 10/2000 | Walsh |
| 6,431,556 | B1 | 8/2002 | Beardsley et al. |
| 6,832,770 | B1 | 12/2004 | Wright-Ott et al. |
| 7,322,584 | B1 | 1/2008 | Parker |

(Continued)

FOREIGN PATENT DOCUMENTS

| | | | |
|---|---|---|---|
| DE | 4202135 | A1 | 7/1993 |
| EP | 0719511 | A1 | 7/1996 |
| JP | 2001-231827 | A | 8/2001 |

OTHER PUBLICATIONS

European Examination Report dated Mar. 11, 2019 for Application No. 14 188 308.2 in 5 pages.

*Primary Examiner* — Megan Anderson
(74) *Attorney, Agent, or Firm* — Knobbe, Martens, Olson & Bear, LLP

(57) ABSTRACT

The present invention relates to a walking aid suitable for supporting patients with cerebral palsy while walking and/or during physiotherapy. The walking aid includes a frame supported by a pair of wheels positioned next to one another, and a support element connected to the frame, for securing the walking aid to a patient. The connection between the support element and the frame allows a rotational movement of the support element with respect to the frame, in two or more rotational degrees of freedom.

14 Claims, 10 Drawing Sheets

(56) References Cited

U.S. PATENT DOCUMENTS

| | | | | |
|---|---|---|---|---|
| 7,678,026 | B2 | 3/2010 | Lewis | |
| 8,091,899 | B2 | 1/2012 | Mejia | |
| 8,100,816 | B2 | 1/2012 | Daniel | |
| 8,469,861 | B1 | 6/2013 | McFee et al. | |
| 9,592,176 | B2 | 3/2017 | Wenmakers et al. | |
| 2005/0164850 | A1* | 7/2005 | Leibowitz ..... | A63B 5/16<br>482/93 |
| 2005/0288157 | A1 | 12/2005 | Santos-Munne et al. | |
| 2006/0055128 | A1 | 3/2006 | Scott et al. | |
| 2007/0290460 | A1 | 12/2007 | Girard et al. | |
| 2008/0018063 | A1 | 1/2008 | Morowat | |
| 2013/0200595 | A1 | 8/2013 | Mackay et al. | |
| 2013/0211295 | A1 | 8/2013 | Johnson et al. | |

* cited by examiner

WALKING AID

TECHNICAL FIELD

The present invention relates to a walking aid suitable for supporting patients whilst walking and/or during physiotherapy.

BACKGROUND

Cerebral palsy (spastic diplegia) is a disorder which is caused by damage to the brain during or before birth. It prevents the brain from being able to communicate with the muscles in a normal way. This may lead to bone and joint deformities because the tension of the muscles against the skeleton is incorrect. As a result, the patient may not be able to move his body, or may not be able to move in an optimal manner.

Although it is not currently possible to treat the cause of cerebral palsy, there are various types of treatment which can limit the effects of the disorder. Each form of treatment typically requires intensive physiotherapy and psychotherapy in order to be successful. Treatment begins as early as possible, because the brain and brain stem of children is more able to adapt to treatment. In practice, this means that one or more physiotherapists work intensively with young patients. This is very difficult and labour intensive.

There are a number of devices which may help and support children whilst walking. However, these devices are generally quite bulky and significantly hinder the child in playing and interacting with his environment. Furthermore, these devices usually support the child in a passive manner. For instance, U.S. Pat. No. 6,832,770 describes a walking aid supported during normal use by at least two sets of wheels, wherein the axis of the primary wheels is located close to the body weight vector. The device is not only bulky around the user, but (also as a result thereof) prevents any translational movement (up/down) of the user as it requires two sets of wheels for support.

Although there are aids available which offer support in an active way via motors, in many cases the high cost price of such devices is an obstacle.

There is therefore a need for improved devices for supporting children whilst walking and for facilitating physiotherapy.

SUMMARY

The present invention relates to a walking aid suitable for supporting patients, including patients with neurological disorders such as cerebral palsy, for example, whilst walking and/or during physiotherapy. More particularly, the present invention provides a walking aid, generally also referred to as an ambulatory, which can support the patient's body in an active and/or passive manner and can control the position of the pelvis in a number of degrees of freedom. The walking aid described in the present application comprises: a frame supported by a pair of wheels positioned laterally (parallel or at an angle) next to one another and a rigid support element connected to the frame, for securing the walking aid to a patient; the walking aid is further characterized by the fact that the connection between the support element and the frame allows a rotational movement of the support element with respect to the frame, in two or more rotational degrees of freedom. In this case, the different rotational degrees of freedom may be determined separately from one another in certain embodiments. In particular embodiments, the invention provides a walking aid comprising a frame supported by only one pair of primary wheels positioned laterally next to one another and a rigid support element connected to the front end of the frame, for securing the walking aid to the back of a patient, wherein the walking aid is characterized in that during normal use, only the primary wheels make contact with the ground and the rigid support is positioned at a distance from the vertical plane formed by the axis of the primary wheels.

In particular embodiments, the connection between the support element and the frame comprises a hinged connection. In further embodiments, the hinged connection comprises a ball hinge.

In certain embodiments, the walking aid is provided with one or more dampers which damp or correct the movement of the support element in one or more directions with respect to a certain position.

In particular embodiments, the maximum angle of rotation of the support element with respect to the frame is adjustable.

In certain embodiments, the walking aid is further provided with one or more motors for driving the pair of wheels. In further embodiments, the wheels can be driven at different speeds and/or in different directions of rotation.

In certain embodiments, the walking aid further comprises one or more support wheels.

In particular embodiments, the walking aid further comprises a weight positioned with respect to the wheels and the support element such that an upwards force is exerted on the support element by means of a lever effect.

In certain embodiments, the walking aid further comprises one or more sensors for determining the movement of the support element in one or more degrees of freedom.

The walking aid described in the present application can support and assist the patient in walking, running, standing or squatting. This is possible without actuators or with only minimal action of actuators. As a result, the walking aid uses little or no energy during operation and there is little or no inertia of the drive when running, standing or squatting. The walking aid can be designed to have a lightweight and compact structure, so that the walking aid hinders the patient as little as possible whilst walking. The simple structure and elements of the walking aid ensure that its cost price can be kept low. In certain embodiments, the walking aid may be adapted to the needs of the patient in a simple manner.

DESCRIPTION OF THE FIGURES

The following description of the figures of specific embodiments of the invention is only given by way of example and is not intended to limit the present explanation, its application or use. In the drawings, identical reference numbers refer to the same or corresponding parts and features.

FIG. 3 FIG. 3(A) shows a side view of a walking aid (1) according to a specific embodiment of the present invention.

FIG. 4 FIG. 4(A) shows a side view of a walking aid (1) according to a specific embodiment of the present invention.

of the walking aid.

FIG. 5 FIGS. 5(A) and 5(B) show a walking aid (50, 51) according to a specific embodiment of the present invention, provided with a damper (52, 53).

FIG. 7 FIGS. 7(A) and 7(B) show a walking aid (60) according to a specific embodiment of the present invention provided with support wheels (62,63).

Figure 1:
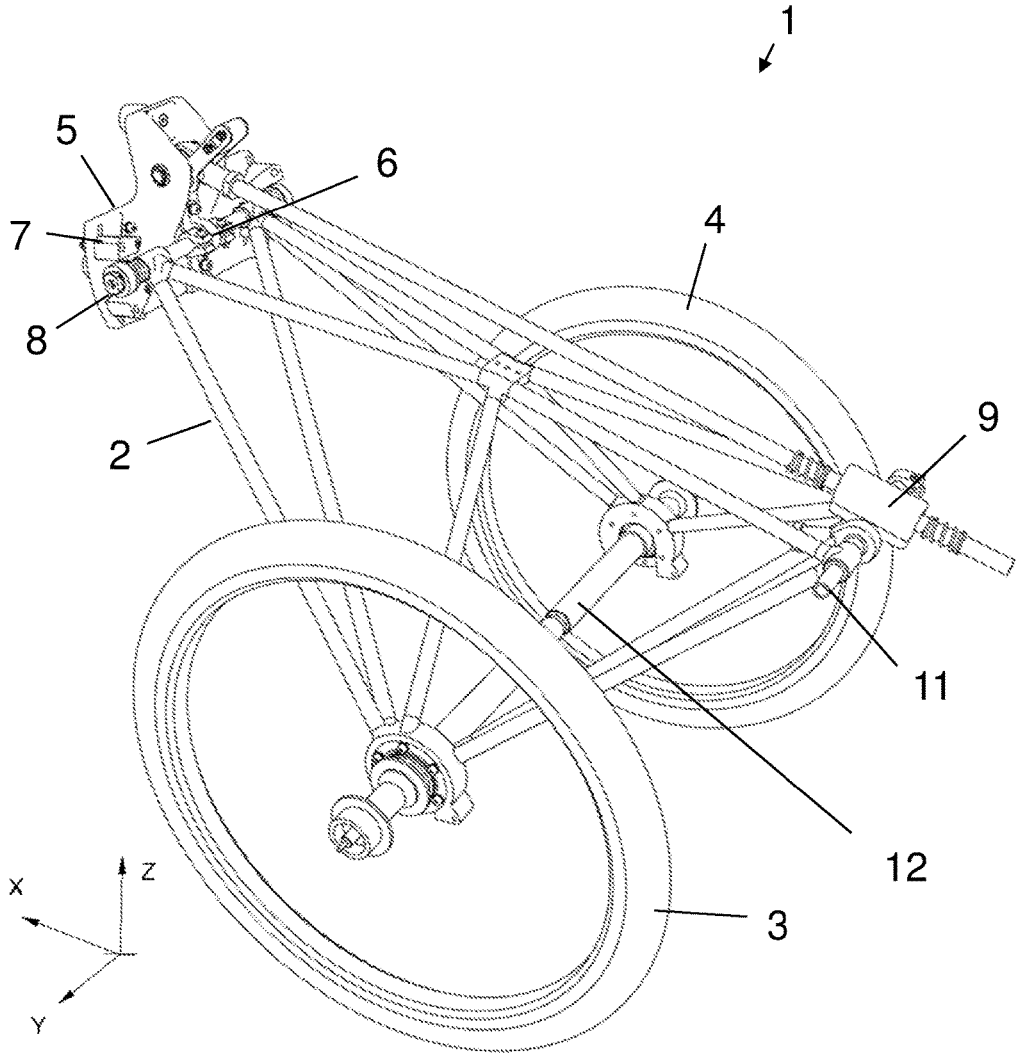
FIG. 1 FIG. 1 shows a representation of a walking aid (1) according to a specific embodiment of the present invention.

The following reference numbers have been used in the description and the figures: 1—walking aid; 2—frame; 3, 4—wheel; 5—support element; 6—hinge; 7-9—control unit for rotation; 11—attachment point; 12—axle; 13—hinge; 20-22—attachment point; 23—hook; 30, 31—stop; 40-43—stop; 44—rod; 45—stop point; 46—spring; 47—sliding bearing; 48—spring; 49—stop point; 50, 51—walking aid; 52, 53—damper; 60—walking aid; 61—drive unit; 62, 63—support wheels.

DESCRIPTION OF THE INVENTION

As used hereinbelow in this text, the singular forms "a", "an" and "the" comprise both the singular and the plural, unless the context clearly denotes otherwise.

The terms "comprise" and "comprises" as used hereinbelow are synonymous with "inclusive", "include" or "contain, "contains" and are inclusive or open and do not exclude additional items, elements or method steps which have not been mentioned. When reference is made in this description to a product or process which "comprises" certain features, parts or steps, this refers to the possibility that other features, parts or steps are also present, but embodiments may also be provided in this case which only contain the listed features, parts or steps.

The enumeration of numerical values by means of ranges of figures comprises all values and fractions included in these ranges as well as the cited end points.

The term "approximately" as used when referring to a measurable value, such as a parameter, a quantity, a time period and so on, is intended to include variations of +/−10% or less, preferably +/−5% or less, more preferably +/−1% or less, and still more preferably +/−0.1% or less, of and from the specified value, in so far as the variations are applicable in order to function in the disclosed invention. It should be understood that the value to which the term "approximately" refers per se has also been disclosed.

All references cited in this description are hereby included in their entirety by way of reference.

Unless otherwise defined, all terms disclosed in the invention, including technical and scientific terms, have the meanings which those skilled in the art normally give them. As a further guide, definitions are incorporated in order to further explain terms which are used in the description of the invention.

The present invention relates to a device suitable for supporting patients with motor disorders, such as, for example, as a result of cerebral palsy, whilst walking and/or during physiotherapy. The device allows the movement of a patient, more particularly the patient's pelvis, to be controlled in one or more degrees of freedom. In certain embodiments, the device may also control the stability of body parts which interact with the pelvis, such as the hip, an upper leg, or a lower leg.

At the same time, the structure of the device is such that in normal use only the primary wheels make contact with the ground. In contrast with prior art devices where the axle of the primary wheels is positioned close to the body weight vector, in the device provided herein in normal use, the axle of the wheels is significantly removed from the body weight vector. Indeed, in normal use, the rigid support, located at the front end of the frame, is positioned at a distance from the vertical plane formed by the axle of the primary wheels. Thus, in normal use, the frame is supported by the primary wheels only.

An important feature of the devices envisaged herein, is the ability to control the movement of the body in different degrees of freedom. A degree of freedom is an independent parameter which defines an aspect of a physical system. The movement of a body in a three-dimensional space can be described on the basis of six degrees of freedom:

- three translational degrees of freedom for describing the translational movements: forwards/backwards, left/right, up/down; and
- three rotational degrees of freedom for describing the rotational movements: for example rotation about three axes at an angle of 45° or more with respect to one another, such as three axes perpendicular to one another. The term "perpendicular" as used in the present application may comprise a certain deviation from an exactly perpendicular orientation, more particularly a deviation of up to 5°, preferably up to 3°, still more preferably up to 1°.

The term "control" as used in the present application refers to influencing the position and/or movement of an object in a broad sense. Thus, controlling the movement of an object may involve damping the movement in one or more degrees of freedom (for example via a damper, brake, stop or the like), but may also involve actively influencing the position of the object (for example via actuators) and/or promoting the return of the object to an equilibrium position (for example by means of a spring). More particularly, the present walking aid allows the different degrees of freedom to be controlled independently of one another.

In certain embodiments, as explained herein below, the term "control" may more particularly comprise "correct", which refers to the fact that a certain movement is permitted, but that beyond a certain deviation from a pre-set standard position there is a control operation to return to said standard position.

More particularly, the present application provides a walking aid, wherein a patient's pelvis can be secured to the walking aid via a support element which is rotatably connected to the rest of the walking aid. In certain embodiments, the device can thus control the position of a patient's pelvis in six degrees of freedom. These features will be explained in more detail below.

The walking aid according to the present invention comprises a frame supported by a pair of wheels positioned parallel to one another, also referred to as "primary wheels" below. The frame provides a connection between the various elements of the walking aid, and forms a structure which is rigid (but optionally adjustable in terms of its dimensions). The frame may be constructed from pipes, sheets, sandwich panels and/or other elements fastened to one another or releasably coupled to one another. In certain embodiments, the frame is made of metal, for example steel, aluminium, titanium or combinations thereof. Additionally or as an alternative, one or more elements of the frame may be made of fibreglass or carbon fibre. In certain embodiments, the frame is made of materials such as steel, aluminium, titanium, fibreglass, carbon fibre or combinations thereof. In certain embodiments, specific parts comprise pipes which can be pushed into one another and can be extended, with it being possible to adjust the length of the pipes in different positions. In certain embodiments, the pipes which determine the height and/or the width of the frame can be extended.

The walking aid comprises two primary wheels positioned laterally next to one another to support the frame. While additional support wheels may be provides (as is detailed below), these are positioned such that they do not provide support for the frame in normal use, but only as support should the body tip backwards. The primary wheels preferably rotate about the same (physical or imaginary) axis. In that case, the primary wheels are usually positioned parallel to one another. However, in certain embodiments provision is made for the primary wheels to be positioned at an angle with respect to the surface of the ground. In such an embodiment, the primary wheels are usually positioned at an angle with respect to one another, in which case they are not connected by one rigid axle, but by the frame and two couplings, in a manner similar to the positioning of the wheels on a wheelchair for wheelchair basketball.

The walking aid described in the present application may be driven by the patient himself, by another person, or by an external actuator. In certain embodiments, the walking aid therefore does not comprise a motor for driving the primary wheels. In certain embodiments, however, the walking aid described in the present application is provided with one or more motors for driving the primary wheels. Preferably, both wheels are driven by the same motor. However, in certain embodiments it is possible for a separate motor to be provided for each of the primary wheels.

For optimum control of the translational movement of the patient it is desirable for the primary wheels to be able to be driven at different speeds and/or in different directions of rotation. Indeed, the difference in rotation between the primary wheels determines the direction in which the walking aid moves: forwards or backwards; left or right. A person skilled in the art will understand that this can be realized in a variety of different ways, for example with the aid of a differential between the transmission and the drive shafts.

The wheels can thus ensure, via the motor, that the translational movement of the patient is actively influenced in two translational degrees of freedom. Furthermore, the wheels may also provide a damping of the translational movement, by driving the wheels in the opposite direction from the movement of the patient and/or by means of brakes.

As described above, the primary wheels of the walking aid may control the translational movements of the patient in two translational degrees of freedom ("forwards/backwards" and "left/right"). However, the primary wheels are not sufficient for controlling the movement of (the pelvis of) the patient in a third translational degree of freedom, namely "up/down".

In practice, movement up or down of the patient will result in a tilting of the walking aid about the axle of the primary wheels. Indeed, the devices of the present invention are designed such that the frame extends in two opposite directions perpendicular to the (hypothetical) vertical plane formed by the axle of the primary wheels. On the other hand, the total weight of the device allows movement of the frame around the axle of the primary wheels. It is thus possible to control the movement of the patient in the third translational degree of freedom by controlling said tilting. This can be achieved by providing one or more dampers, for example weights or support wheels, positioned in front of or behind the axle of the primary wheels, i.e. on same or opposite sides of the primary wheels as the support element. In particular embodiments, the dampers or support wheels are positioned behind the axle of the primary wheels. As well as controlling the movement, the dampers can also ensure that the walking aid is in a stable position when it is not in use. However, the dampers should not support the walking aid in normal use. In certain embodiments, the dampers allow a maximum tilt of less than 15°, less than 10° or less than 5° about the axis (axle) of the primary wheels. Thus, it will be clear that where the primary wheels and dampers (or controlling wheels) are in the same plane (e.g. all touching the ground), the support structure is in a tilted position, which does not correspond to the normal use of the device.

In certain embodiments, the dampers are arranged to be positioned higher than the primary wheels so that they do not touch the ground when the patient is in a normal (desired) position. In this way, the dampers cause the least possible hindrance when performing the desired movements. Beyond a certain tilting angle of the walking aid, one or more dampers do touch the ground, which prevents any further tilting (and any further upwards or downwards movement of the patient). In certain embodiments, the position or height of one or more dampers is adjustable.

In certain embodiments, one or more dampers are provided with a shock absorber, such as a spring. This may increase the comfort of the patient and provide additional control over the position of the patient.

Figure 3A:
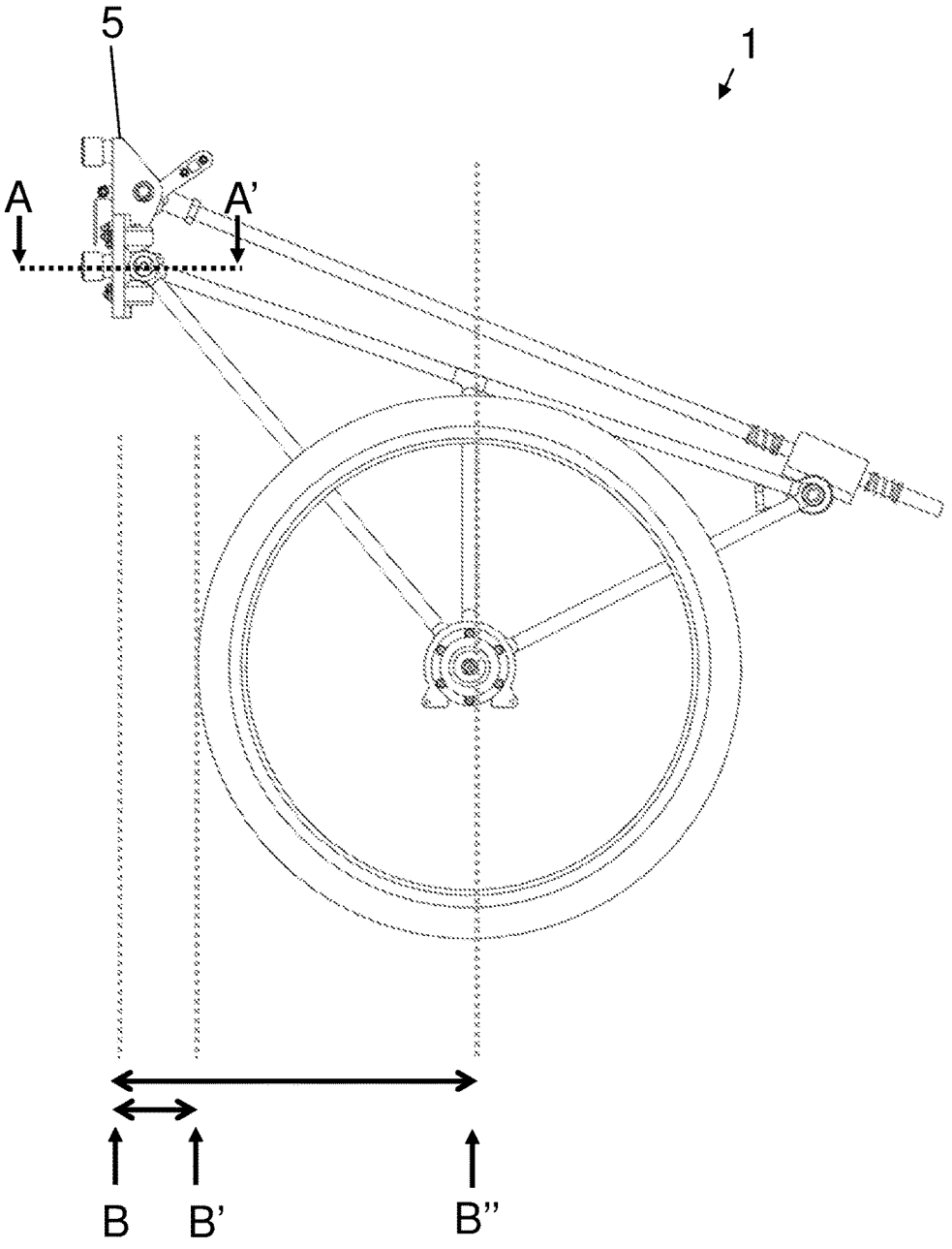

The walking aid according to the present invention is further provided with a support element which is connected to the frame. More particularly, the support element is positioned on the end of the frame removed from the axis of the primary wheels, which ensures that the axis of the primary wheels is removed from the body weight vector of the patient. In particular embodiments, the axis of the primary wheels is removed at least 10 cm, more particularly at least 15 cm, typically between 15 and 50 cm from the body weight vector. Typically this implies that the support element is also removed at least 15 cm from the axis of the wheels (as illustrated in FIG. 3A by distances B-B"). The support element ensures that the patient can be secured to the walking aid, preferably by means of the patient's pelvis. Accordingly, the frame should extend at least from the axis of the wheels to the height of the patient's body part.

The actual shape of the support element is partially determined by the shape of the body part to be supported and the number of degrees of freedom to be controlled. After all, it is necessary for the support element to allow the body part to be controlled. In these embodiments, where the support element is intended for a patient's pelvis, the width of the support element will ideally correspond to the width of the pelvis. In certain embodiments, (at least) part of the support element extends along the axis which is perpendicular to the axis corresponding to the axis of the pelvis up to a point which is higher than the pelvis (the lower back). More particularly, in certain embodiments the overall form of the support element is T-shaped, with the transverse element being longer than the vertical element.

The connection between the patient's pelvis and the support element is preferably as rigid as possible, so that no movement or hardly any movement is possible between the support element and the body part, such as the pelvis. The support element itself also typically has a rigid, but possibly adjustable, structure. In this way, each rotation of the patient's pelvis rotates the support element with respect to the frame (see below), as a result of which the walking aid controls the position of the pelvis in an optimum manner. In certain embodiments, the control element comprises two or more parts which make it possible to adjust the width and/or the height of the support element.

The connection between the patient and the support element can be realized in a number of different ways. In certain embodiments, the support element may comprise a harness, strap, brace, or the like, in which the patient can be secured, for example via the pelvis. In further embodiments, the harness or the like may be attached to and released from the support element in a reversible manner. The connection between the harness and the support element is preferably such that the harness is unable or barely able to move with respect to the support element.

The connection between the support element and the frame allows a certain movement between these elements. More particularly, the support element is connected to the frame in such a way that the support element can rotate in one, two or three rotational degrees of freedom with respect to the frame. In a preferred embodiment, the support element can rotate in three rotational degrees of freedom with respect to the frame.

Specifically, this means that a rotational movement is possible about two (two rotational degrees of freedom) or three (three rotational degrees of freedom) axes which are preferably perpendicular to one another.

Such a connection can take various forms. Thus, for example, the support element may be connected to the frame via one or more hinges, one or more springs, a resilient material (for example foam rubber), or combinations thereof. In a preferred embodiment, the support element is connected to the frame via a hinged connection, more preferably via a ball hinge. A ball hinge allows rotations in three dimensions and therefore provides a connection having a high degree of rotational freedom.

In certain embodiments, the movement of the support element with respect to the frame is controlled by the attachment of the support element to the frame at different positions. In certain embodiments, the support element is connected to the frame at two points situated on the same horizontal axis. Said points above all allow the horizontal left/right movement of the pelvis to be actively controlled. In certain embodiments, the support element is additionally connected to the frame at a third point situated centrally above said horizontal axis (at a distance corresponding to a location above the patient's pelvis). The latter allows an even better control of the pelvis in the six degrees of freedom.

The angle of rotation of the support element with respect to the frame is preferably limited in one, two or all three of the rotational degrees of freedom, in order to be able to control the rotational movement of the patient's pelvis in an optimum fashion. It is thus possible, for example, to provide a number of obstructions or stops which limit the rotation of the support element about one or more axes to a certain angle of rotation.

In certain embodiments, the maximum angle of rotation in each of the rotational degrees of freedom is less than 20°, preferably less than 15°, and still more preferably less than 10°. In a preferred embodiment, the maximum angle of rotation is adjustable in one or more rotational degrees of freedom, for example by moving, removing or adding stops.

In certain embodiments, dampers may be provided which ensure that the rotational movement of the support element (and therefore also of the patient's pelvis) is damped or corrected. Suitable dampers may take different forms. In a preferred embodiment, the dampers comprise a resilient element, such as a spring. Dampers may ensure that the rotational movement of the support element are damped. Dampers may also ensure that, in the event of a rotational movement of the pelvis, forces are exerted on the pelvis which help it to return to an optimum equilibrium position. This may therefore increase the control over the patient's movements. The function of the dampers will in part also be determined by their position relative to the primary wheels and the support element. Where the damper is positioned on the opposite side of the primary wheels from the support element, it will dampen the upward/backward movement of the pelvis (and support element). Where the damper is positioned on the same side of the primary wheels as the support element, it will dampen the downward/forward movement of the pelvis.

In certain embodiments, the walking aid is provided with one or more actuators which can influence the angle of rotation of the support element with respect to the frame. In this way, the patient's pelvis may be brought into the desired orientation in an active manner, and it is therefore possible to provide the patient with active support. Examples of suitable actuators are known to the person skilled in the art and comprise electric motors, pneumatic actuators, electromagnetic actuators, etc. The actuators may be operated manually or automatically, for example using input obtained via one or more sensors.

In certain embodiments, the walking aid described in the present application thus comprises one or more sensors for determining the movement and/or position of the support element in one or more degrees of freedom. The information obtained via the sensors can be used to monitor the position of the support element (and therefore also of the pelvis), and may possibly be used to adjust the position. Indeed, in certain embodiments, one or more actuators of the walking aid can be controlled on the basis of the position information obtained via the sensors. It is thus possible to ensure that the pelvis is always in an acceptable position.

In certain embodiments, the walking aid is configured to generate a warning signal as soon as the position measured by one of the sensors exceeds a certain threshold, more particularly when the position of the patient exhibits a certain deviation from the intended position. Such a warning signal may take different forms, such as an auditory signal, a visual signal, a locking of the primary wheels, or a combination thereof.

In certain embodiments, the measured data can be stored on a storage medium. These data may help to evaluate the therapy. The storage medium may be provided on the walking aid itself, or may be situated elsewhere. In certain embodiments, the measured data are transmitted wirelessly to a monitoring unit.

As described above, the "up/down" movement of the patient's pelvis can, in particular embodiments be controlled with the aid of one or more dampers, such as for instance a weight positioned on the opposite side of the primary wheels from the support element, which ensure that an upwards force is exerted on the support element by means of a lever effect. Said upwards force may offer considerable support to the patient whilst walking. In the case of said lever effect, the wheel axle typically forms the fulcrum, with the fixed body part and the weight being located on opposite sides of the fulcrum. The weight, by means of gravity, and the lever effect therefore ensure that an upwards force is exerted on the fixed body part. In a preferred embodiment, the weight is removable and/or adjustable. The upwards force can therefore be adjusted to meet the patient's needs.

In addition or as an alternative, the one or more dampers may function as a control element, to avoid excessive forward or backward movement of the patient's pelvis, in order to avoid falling (as described above). This is of particular interest in the case of weaker patients.

In certain embodiments, the walking aid is provided with a programmable control unit for controlling the actuators. The programming may optionally be effected via a computer which is (wirelessly) connected to the control unit.

The present invention shall be illustrated by way of the following non-limiting embodiments.

EXAMPLES

FIG. 1 shows a representation of a walking aid (1) according to a certain embodiment of the present invention. The walking aid may provide support to the patient's body in an active and passive way and control the position of the pelvis in 6 degrees of freedom, more particularly three translational degrees of freedom and three rotational degrees of freedom. In the text below, a coordinate system as illustrated in FIG. 1 is used to describe controlling the position of the pelvis in said degrees of freedom. The walking aid (1) comprises a rigid frame (2) supported on two wheels (3, 4), and a support element (5) for securing a patient to the device. These elements and their function will be explained in more detail below.

The walking aid (1) comprises a support element (5) for securing the patient's pelvis to the walking aid. The securing can be effected by means of a three-point suspension, with the pelvis being secured to the support element at three points. As a result, the position of the patient is secured with respect to the support element in all of the degrees of freedom.

The support element is provided in such a way that the walking aid is located entirely on one side of the patient, more particularly behind the patient. In this way, the freedom of movement of the patient's pelvis can be adjusted separately in all six degrees of freedom.

Figure 2:
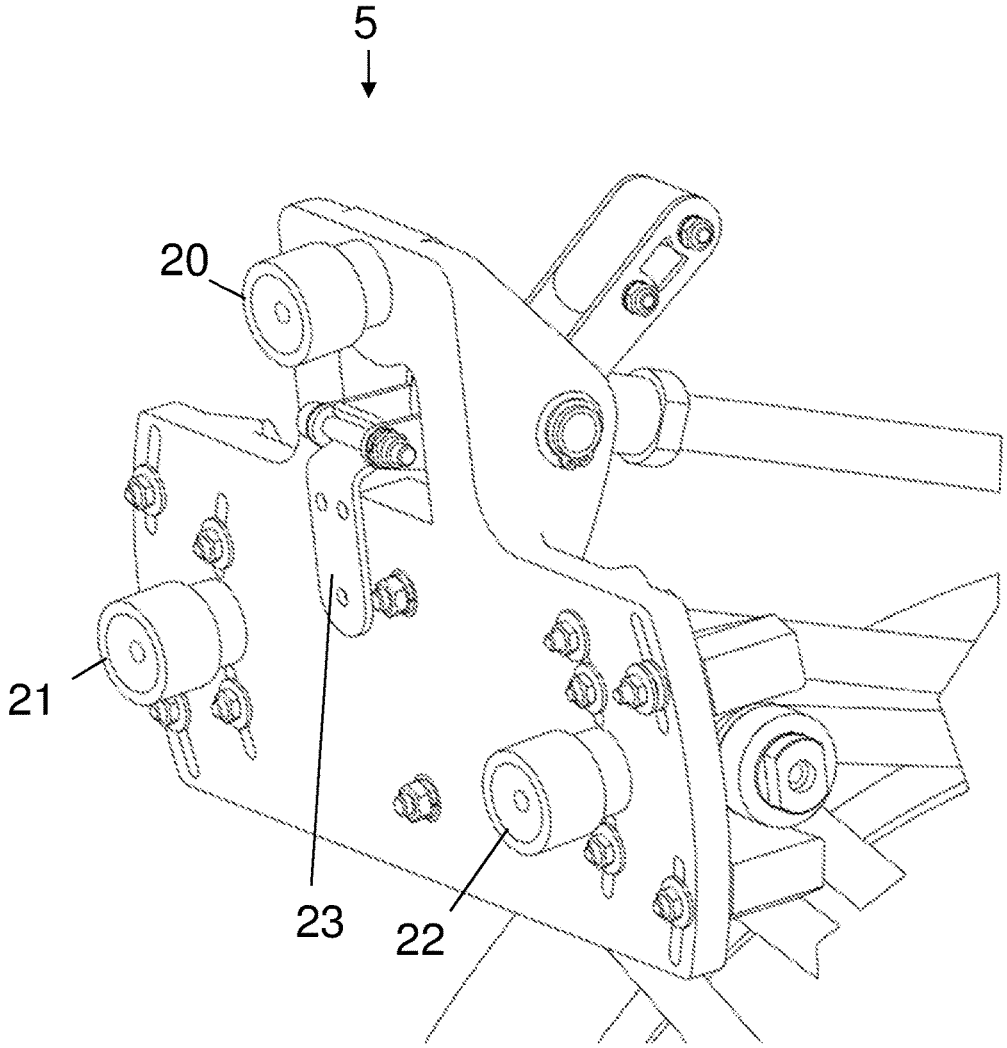
FIG. 2 FIG. 2 shows support element (5) of a walking aid (1) according to a specific embodiment of the present invention.

FIG. 2 shows a detailed illustration of the support element (5). The support element is provided with three fixed attachment points (20, 21, 22) and a hook (23) for attaching the patient to the support element. The patient may be attached by means of a harness or strap worn around the patient's pelvis, wherein the strap is provided with attachment elements which correspond to the attachment points (20-22). Importantly, the support element is attached such that the device is place behind the patient. Thus, the support element is located on one end of the frame, removed from the vertical plane of the axis of the wheels and the remainder of the device (as illustrated in FIG. 3A with distances B-B"). More particularly, in normal use, the support element is positioned in front of the wheels, i.e. in front of the vertical plane connecting the outer edge of both primary wheels (as illustrated in FIG. 3A with distances B-B').

The support element (5) is hingedly connected to the frame (2) via a ball hinge (6). The ball hinge allows rotation of the support element with respect to the frame in three rotational degrees of freedom, more particularly rotation about three axes positioned perpendicularly with respect to one another and being parallel to the X, Y and Z axes illustrated in FIG. 1. The ball hinge is located close to the secured pelvis, so that rotation of the pelvis is associated with the smallest possible translational movement.

The angle of rotation of the support element (and therefore also of the secured object) with respect to the frame is not unlimited and can be adjusted by control units (7-9). In this way, it is possible to control the position of the secured pelvis in the rotational degrees of freedom.

Figure 3B:
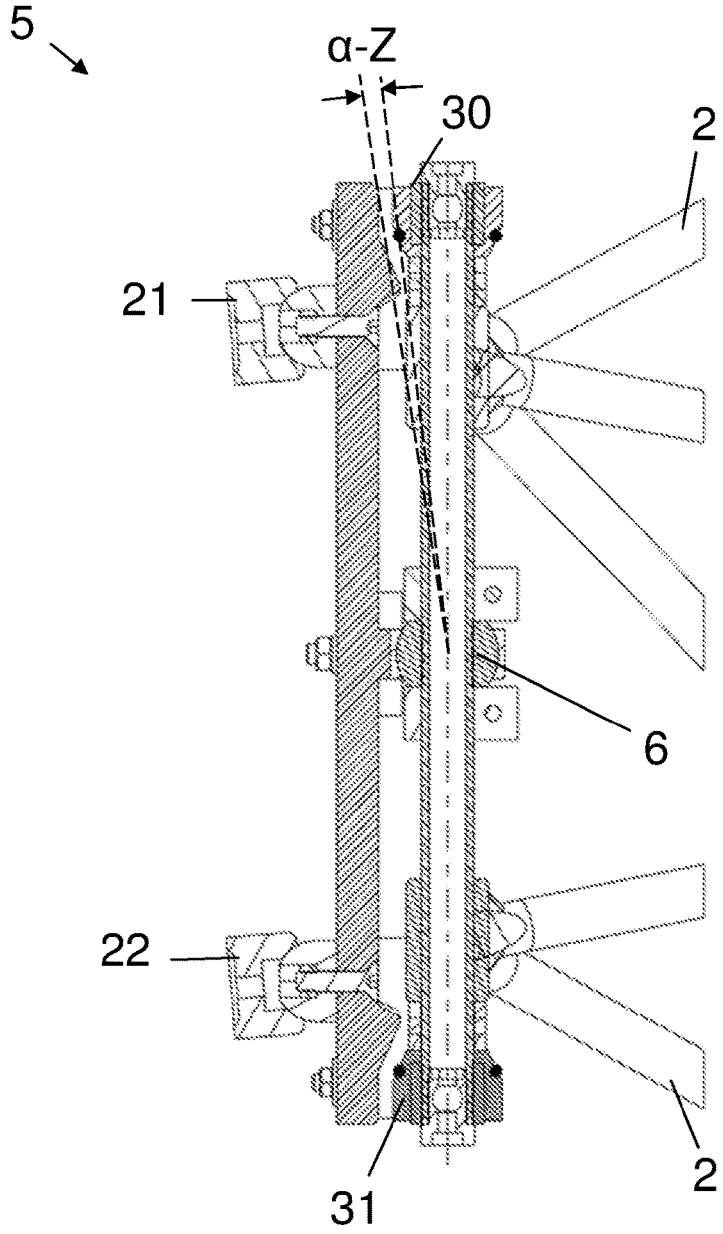
FIG. 3(B) shows a cross section of the support element (5) of the walking aid.

More particularly, the angle of rotation α-Z about an axis parallel to the Z axis is limited by providing two fixed stops (30, 31), each of which is provided with a rubber damper. This is shown in FIG. 3B, which illustrates a cross section A-A' of the support element (5) in FIG. 3A. It is possible to adjust the maximum angle of rotation α-Z, for example by means of an adjusting screw. In certain embodiments, the walking aid may further be provided with a spring, damper or actuator in order to influence the angle of rotation α-Z of the secured pelvis.

Figure 4A:
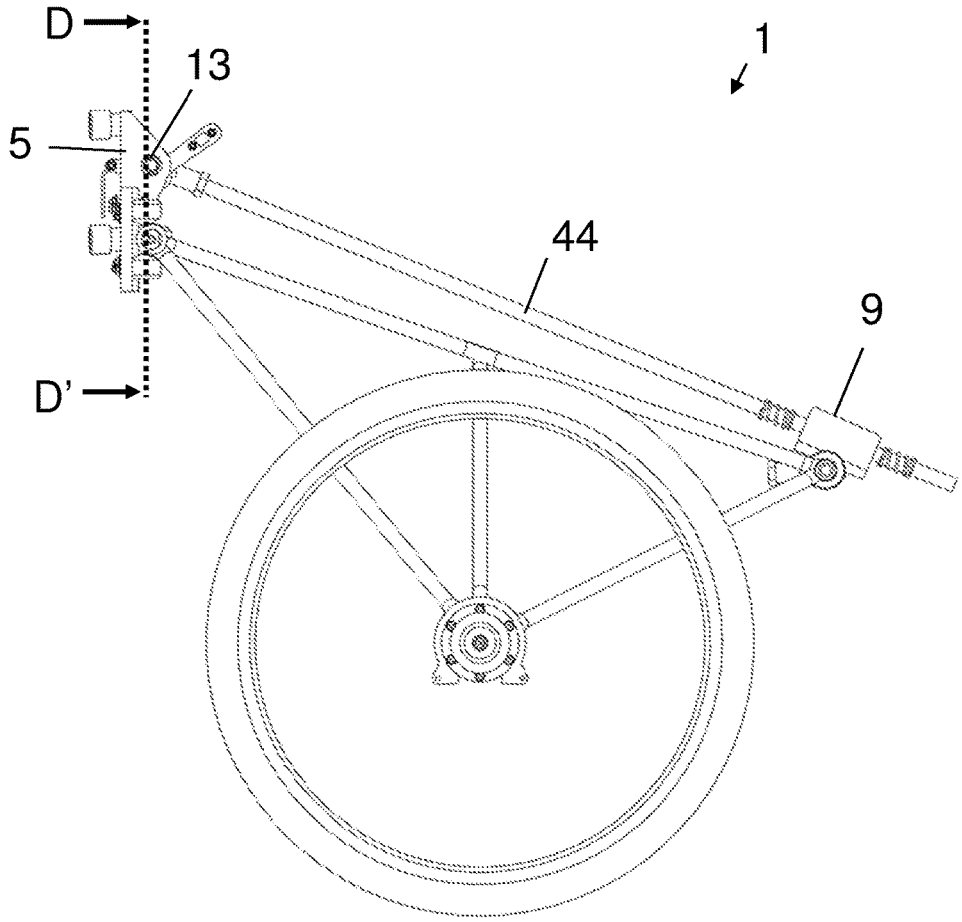
Figure 4B:
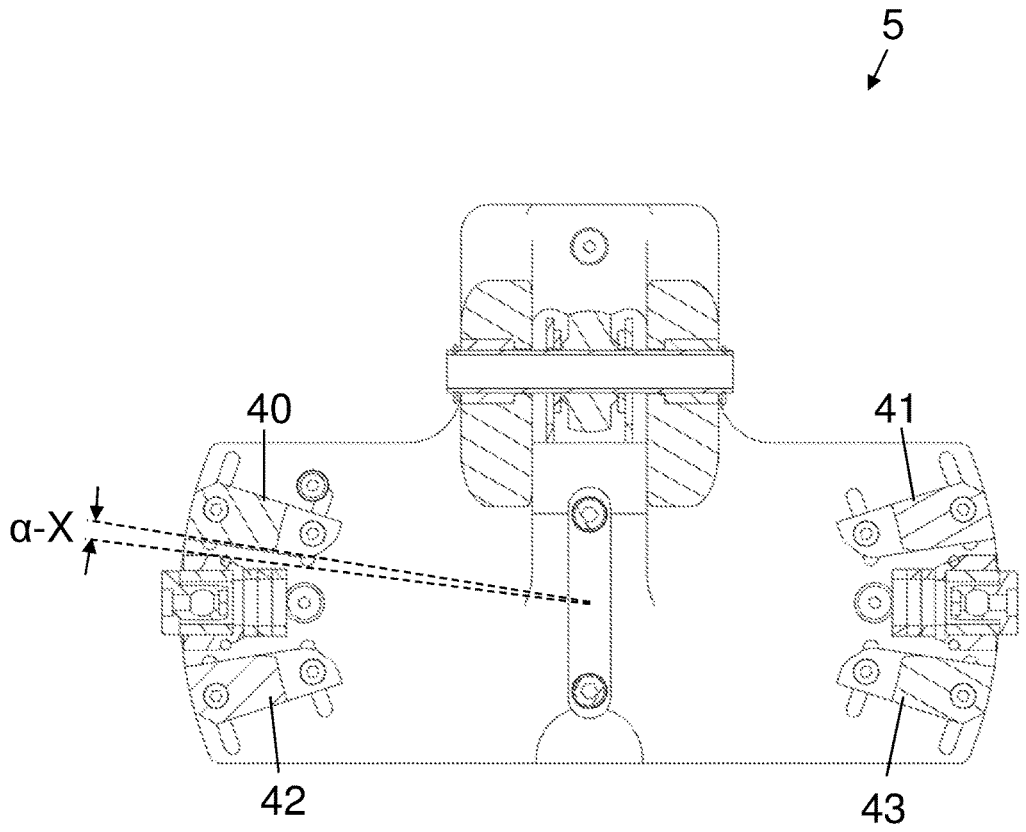
FIG. 4(B) shows a cross section of the support element (5)

The angle of rotation α-X about an axis parallel to the X axis is limited by providing two fixed stops (40, 41), each of which is provided with a rubber damper. This is shown in FIG. 4B, which illustrates a cross section D-D' of the support element (5) in FIG. 4A. It is possible to adjust the maximum angle of rotation α-X, for example by changing the position of the stops. In certain embodiments, the walking aid may also be provided with a spring, damper or actuator in order to influence the angle of rotation α-X of the pelvis. The support element (5) is furthermore provided with two additional stops (42, 43). The additional stops (42, 43) do not provide any additional limitation of the angle of rotation α-X, but serve to keep the forces exerted on the frame symmetrical.

Figure 4C:
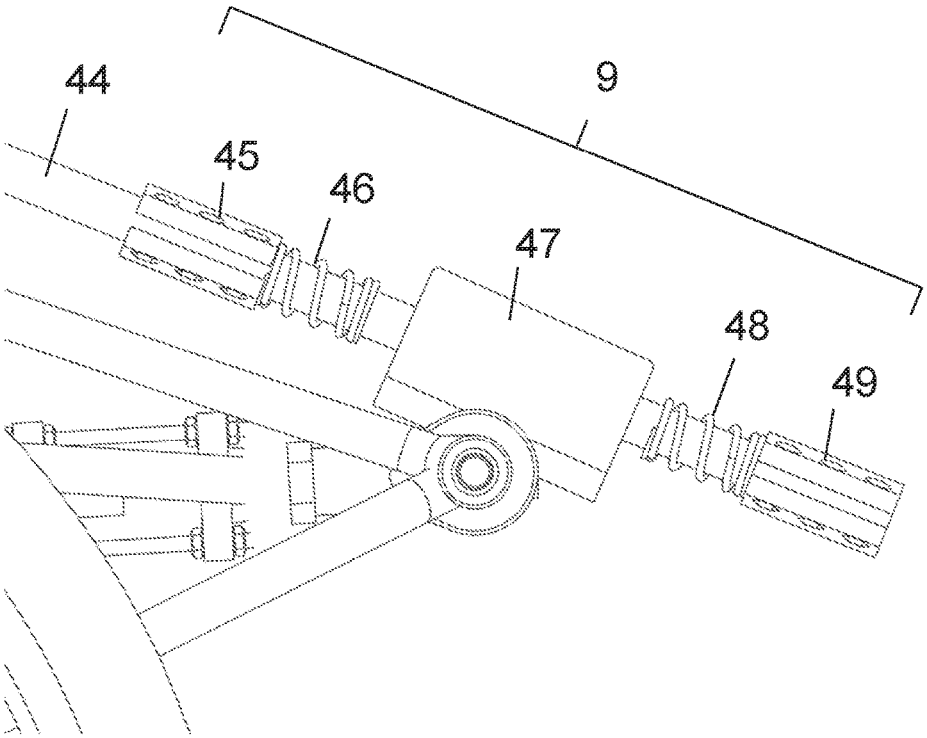
FIG. 4(C) shows a detailed drawing of a control unit for limiting the angle of rotation α-Y of the support element (5)(C).

The angle of rotation α-Y about an axis parallel to the Y axis is limited by the control unit (9) for rotation about the Y axis. The control unit (9) comprises a rod (44), one end of which is hingedly connected to the support element (5) by means of a hinge (13), and the other end of which is provided with two springs (46, 48) on two fixed stops (45, 49), as shown in FIG. 4C. Between the springs (46, 48) is a sliding bearing (47) in which the rod (44) can slide. In this case, the angle of rotation is therefore controlled by a limitation of the angle of rotation and additionally a spring force which is directed away from said stops. In certain embodiments, the walking aid may furthermore be provided with an actuator in order to influence the angle of rotation α-Y of the pelvis.

The walking aid (1) furthermore comprises a pair of primary wheels (3, 4) which rotate about a common axle (12). The wheels are provided with rubber tyres, which results in a high degree of friction on most types of surfaces. In this way, during normal use, the primary wheels provide the only support to the patient.

Figure 6:
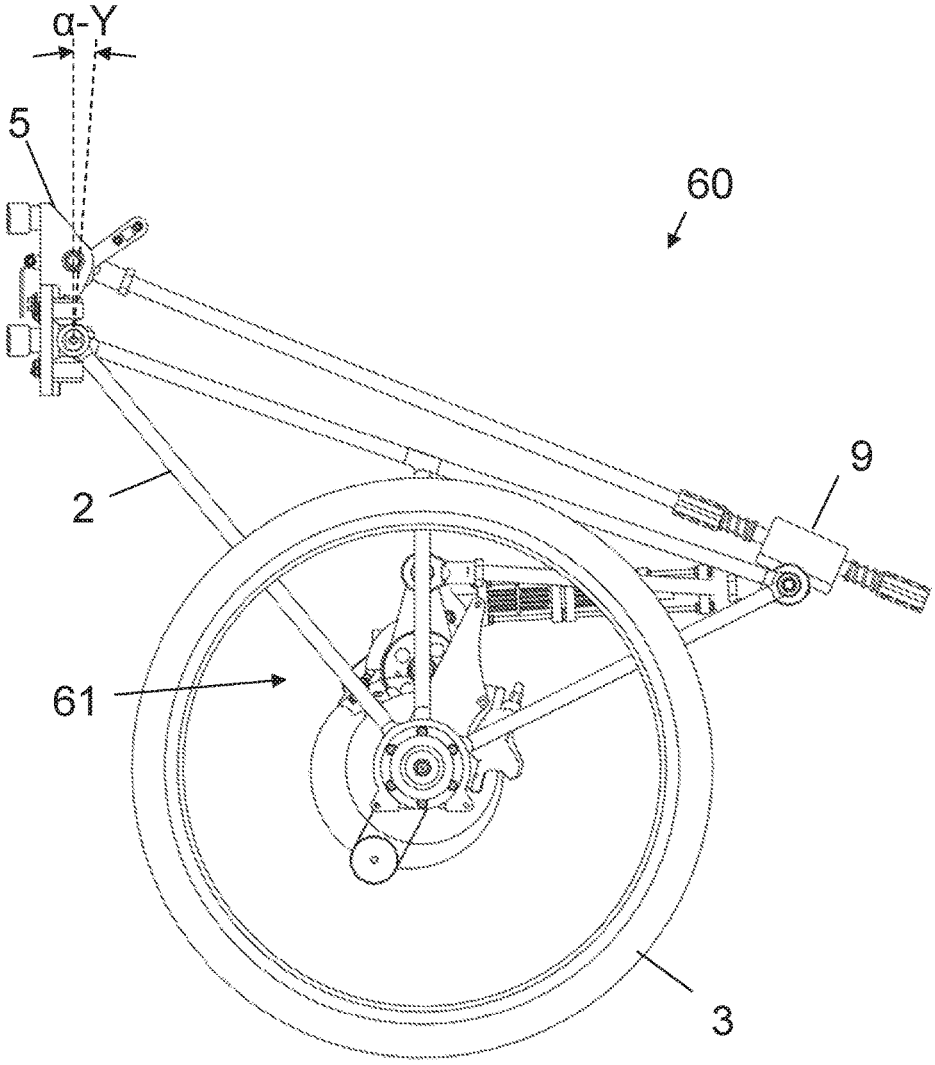
FIG. 6 FIG. 6 shows a walking aid (60) according to a specific embodiment of the present invention, provided with a drive unit (61).

The primary wheels may be driven by a drive unit (61) having an (electric) motor (FIG. 6), and may, if desired, rotate independently of one another by means of a differential.

Both primary wheels are controlled via a control unit. The control unit can control the mutual difference in rotation of the two primary wheels by means of a differential, more particularly a differential gear embodiment with opposite drive direction. It is therefore possible to control the position of the pelvis in any direction within the XY plane, in other words forwards/backwards and left/right, by moving the wheels. Additionally or as an alternative, the control unit may be provided with a servomotor. The person skilled in the art will understand that yet further embodiments are possible. In certain embodiments, the wheel axle may, for example, be provided with two torsion springs having a central stop.

It is possible to control the position of the pelvis on the Z axis (up/down) by providing a weight which can exert an upwards force on the pelvis via a lever effect. For this purpose, the walking aid (1) is provided with an attachment point (11) to which one or more weights can be attached. The weight and the patient's pelvis are located on opposite sides of a lever, with the wheel axle (12) as the fulcrum. Since gravity exerts a downwards force on the weight, an upwards force is exerted on the pelvis as a result of the lever action. This ensures that the pelvis is supported and its position is controlled.

Figure 7:
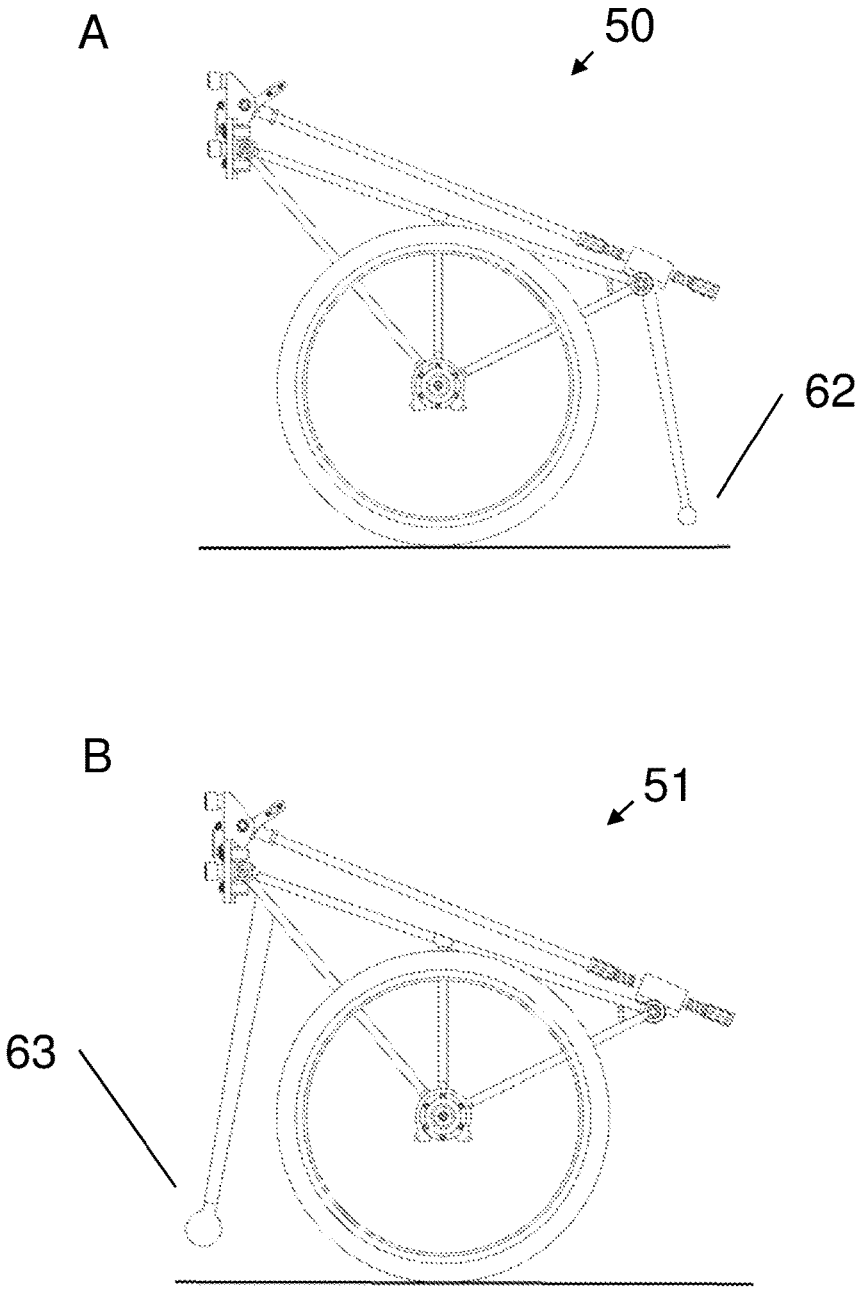

Additionally or as an alternative, the position of the pelvis on the Z axis may be controlled by providing one or more support points, for example dampers or support wheels (62, 63). The support wheels, if present, are positioned in such a way that they do not touch the ground when the pelvis is in an acceptable position, but do touch the ground in the event of a certain (positive and/or negative) deviation from the equilibrium position in the Z direction (FIGS. 7A and 7B).

Figure 5:
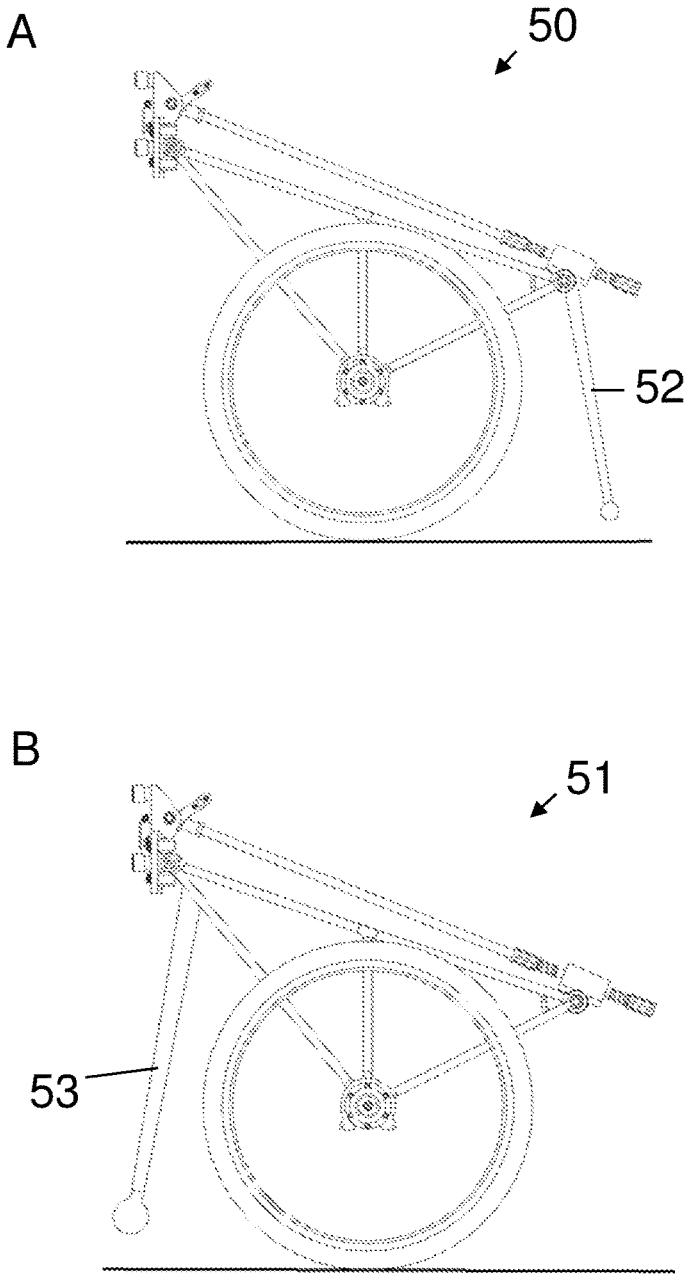

FIG. 5A shows a walking aid (50) according to a certain embodiment of the present invention, having a damper (52) which limits the positive deviation of the pelvis from the equilibrium position in the Z direction. FIG. 5B shows a walking aid (51) according to a certain embodiment of the present invention, having a damper (53) which limits the negative deviation of the pelvis from the equilibrium position in the Z direction. The damper (53) is attached to the frame (2) and may be detached, if desired. In certain embodiments, the walking aid described in the present application may be provided with both types of damper (52, 53).

What is claimed is:

1. A walking aid for securing to a back side of a patient at the level of a pelvis of the patient, comprising:

a frame supported by only one pair of primary wheels positioned laterally next to one another which rotate around a common wheel axle; and a rigid support element connected to a front end of the frame in a connection, the rigid support element for securing the walking aid to the back side of the patient; wherein, during normal use, only the one pair of primary wheels make contact with a ground and the rigid support element is positioned at a distance from a vertical plane formed by an axis of the one pair of primary wheels; and wherein the connection between the rigid support element and the frame comprises a hinged connection which allows a rotational movement of the rigid support element with respect to the frame, in two or more rotational degrees of freedom, wherein one or more dampers are provided which ensure that said rotational movement of the support element is damped or corrected; wherein said one or more dampers comprise a pair of springs.

2. The walking aid according to claim 1, comprising a control unit for limiting said rotational movement in an angle of rotation α-Y of the rigid support element.

3. The walking aid according to claim 2, wherein said control unit comprises a rod, one end of which is hingedly connected to the rigid support element by a hinge, and the other end of which is provided with the pair of springs.

4. The walking aid according to claim 3, further comprising a sliding bearing between the pair of springs in which the rod slides.

5. The walking aid according to claim 4, wherein the walking aid is further provided with an actuator in order to influence said rotational movement in an angle of rotation α-Y of the pelvis.

6. The walking aid according to claim 1, wherein the walking aid is further provided with a control unit in order to influence the position of the pelvis in an XY-plane.

7. The walking aid according to claim 6, wherein the control unit for influencing the position of the pelvis in the XY-plane is positioned on the common wheel axle.

8. The walking aid according to claim 1, further provided with one or more motors for driving the one pair of primary wheels.

9. The walking aid according to claim 8, wherein the one primary wheels are configured to be driven at different speeds and/or in different directions of rotation.

10. The walking aid according to claim 1, wherein the hinged connection comprises a ball hinge.

11. The walking aid according to claim 1, wherein a maximum angle of rotation of the support element with respect to the frame is adjustable.

12. The walking aid according to claim 1, further comprising one or more support wheels, which do not contact the ground during normal use.

13. The walking aid according to claim 1, further comprising a weight positioned with respect to the one pair of primary wheels and the rigid support element such that an upwards force is exerted on the rigid support element by a lever effect.

14. The Walking aid according to claim 1, wherein said one or more dampers further comprise one or more fixed stops.

* * * * *